US008113787B2

(12) United States Patent
Barril et al.

(10) Patent No.: US 8,113,787 B2
(45) Date of Patent: Feb. 14, 2012

(54) TURBOMACHINE BLADE WITH EROSION AND CORROSION PROTECTIVE COATING AND METHOD OF MANUFACTURING

(75) Inventors: Marie-Gilles Barril, Birmenstorf (CH); Piero-Daniele Grasso, Oberweningen (CH); Alexander Stankowski, Siggenthal-Station (CH)

(73) Assignee: ALSTOM Technology Ltd., Baden (CH)

( * ) Notice: Subject to any disclaimer, the term of this patent is extended or adjusted under 35 U.S.C. 154(b) by 1258 days.

(21) Appl. No.: 11/765,599

(22) Filed: Jun. 20, 2007

(65) Prior Publication Data

US 2008/0317601 A1 Dec. 25, 2008

(51) Int. Cl.
*F01D 5/28* (2006.01)

(52) U.S. Cl. ..... 416/224; 416/241 R

(58) Field of Classification Search ..... 416/224, 416/241 R

See application file for complete search history.

(56) References Cited

U.S. PATENT DOCUMENTS

| | | | | |
|---|---|---|---|---|
| 3,908,066 | A * | 9/1975 | Parkinson | 428/379 |
| 3,951,612 | A * | 4/1976 | Gates et al. | 428/627 |
| 4,125,646 | A | 11/1978 | Dean et al. | |
| 4,537,632 | A | 8/1985 | Mosser | |
| 5,279,649 | A | 1/1994 | Stetson et al. | |
| 5,747,163 | A | 5/1998 | Douglas | |
| 5,773,141 | A * | 6/1998 | Hasz et al. | 428/335 |
| 6,475,297 | B1 * | 11/2002 | Rafferty et al. | 148/240 |
| 6,609,894 | B2 * | 8/2003 | Jackson et al. | 416/224 |
| 7,186,092 | B2 * | 3/2007 | Bruce et al. | 416/241 R |
| 2002/0197152 | A1 | 12/2002 | Jackson et al. | |
| 2003/0129061 | A1 * | 7/2003 | Finn et al. | 416/224 |
| 2006/0018760 | A1 | 1/2006 | Bruce et al. | |
| 2007/0017958 | A1 | 1/2007 | Hasz et al. | |

FOREIGN PATENT DOCUMENTS

| | | |
|---|---|---|
| CA | 2039944 | 10/1991 |
| EP | 1666633 | 6/2006 |
| EP | 1700929 | 9/2006 |
| EP | 1826363 | 8/2007 |
| GB | 2241961 | 9/1991 |

OTHER PUBLICATIONS

International Search Report for PCT Patent App. No. PCT/EP2008/052979 (Oct. 27, 2008).

* cited by examiner

*Primary Examiner* — Edward Look
*Assistant Examiner* — Ryan Ellis
(74) *Attorney, Agent, or Firm* — Cermak Nakajima LLP; Adam J. Cermak

(57) ABSTRACT

A turbomachine blade (1) includes a blade body (2) and a corrosion and erosion protective multilayered coating (11) bonded thereto, the multilayered coating (11) including an erosion resistant first layer (3) at least covering a corrosion and erosion critical area (5) of the blade body (2) and a sacrificial second layer (4) provided over the first layer (3) at least covering the first layer (3), preferably covering the blade totally. A method of manufacturing such a turbomachine blade includes the steps of providing a blade and depositing the erosion resistant first layer on the blade body so as to cover at least the corrosion and erosion critical area, followed by depositing the sacrificial second layer over the first layer at least covering the first layer.

29 Claims, 1 Drawing Sheet

TURBOMACHINE BLADE WITH EROSION AND CORROSION PROTECTIVE COATING AND METHOD OF MANUFACTURING

BACKGROUND

1. Field of Endeavor

The present invention relates to a turbomachine blade, in particular to a compressor blade for use in a gas turbine engine. The present invention also relates to a method of manufacturing a turbomachine blade, the method including the step of depositing a corrosion and erosion protective coating on the turbomachine blade body.

2. Brief Description of the Related Art

It is known from the state of the art that turbomachine blades, in particular compressor blades, which are made of metallic material such as stainless steel, are susceptible to corrosion, in particular pitting corrosion.

Pitting corrosion is a form of localized corrosion that leads to the creation of small holes in the metallic material based on galvanic corrosion. As is known, pitting corrosion can be initiated by small surface defects such as scratches, holes or local changes of the composition of the material and it may be aggravated by salt deposits and humidity during operation or stand still of the turbine engine.

Due to water droplets and particulate matter impacting on the leading edge area of compressor blades in a gas turbine, pitting corrosion is a frequently occurring degradation mechanism for compressor blading.

Moreover, pitting corrosion is extremely insidious as it causes only little loss of material with small effects on the metal surface. However, it causes serious damages in the deep structure of the metal. When corrosion pits reach a certain depth, particularly in the leading edge area of the blade, they can lead to the formation of cracks, which may finally result in blade failure due to high cyclic fatigue (HCF).

In order to avoid pitting corrosion, it is known to deposit corrosion protective layers on the blade body material. In recent years, sacrificial slurry coatings have become rather popular for use as corrosion protective layers, in particular for use in the front stages in compressor blading. These coatings are sacrificial because they are attacked instead of the blading material. However, it has become apparent that even sacrificial slurry coatings are prone to degradation in highly erosive conditions, as they typically can be found at the leading edges of compressor blades due to water droplets and particles that hit the blades very hard. Because of local loss of the coating's erosion resistant property, corrosion of the leading edge area may occur.

SUMMARY

In light of the above, one of numerous aspects of the present invention includes suppressing pitting corrosion of a turbomachine blade and providing a turbomachine blade that has an improved corrosion and erosion protective coating to enable a longer working life of the blade. Another aspect of the present invention includes providing a method of manufacturing such a turbomachine blade.

According to yet another aspect of the invention, a turbomachine blade, which may be a compressor blade, includes a blade body and a corrosion and erosion protective multilayered coating bonded to the blade body. The multilayered coating has an erosion resistant first layer and a sacrificial second layer, with the latter being provided in overlying relationship to the former.

Preferably, the erosion resistant first layer is selected so as to provide erosion resistance against water droplets or particles impacting on it. In case the blade body is made of stainless steel, the first layer may be selected so as to provide stainless steel corrosion resistance as well.

According to a further aspect of the invention, the erosion resistant first layer is deposited so that it covers at least a corrosion (and erosion) critical area of the blade body, such as a leading edge area of the blade. However, it may be preferred that the first layer exclusively covers the erosion critical area of the blade body and does not cover any area of the blade body not belonging to the erosion critical area.

Depending on the severity of the erosion attack, the first layer preferably covers an area of up to 30% of the chord length starting from the leading edge towards the suction and pressure sides of the blade, that is to say, towards the trailing edge of the blade. The first layer may cover an area of from 5% to 30% of the chord length starting from the leading edge towards the trailing edge. But it may also cover an area of up to 60% or more of the chord length starting from the leading edge towards the trailing edge in case of a stronger impact of particulate matter and water droplets.

The sacrificial second layer is deposited so that it covers the first layer at least totally. However, it may be preferred that the sacrificial second layer covers the blade body totally.

In a turbomachine blade embodying principles of the present invention, it may be preferred that the first layer is sandwiched between the blade body and the second layer. Accordingly, the first layer is arranged so as to be an intermediate layer between the blade body and the second layer in an adjacent relationship relative to the blade body and the second layer.

According to further aspects of the present invention, the first layer may have a layer thickness in the range of from 50 to 100 micrometer (μm) while the second layer may have a layer thickness in the range of from 50 to 100 micrometer (μm) resulting in a total protective coating thickness in the range of from 100 to 200 micrometer (μm), with a maximum total thickness of 200 micrometer (μm).

Preferably, the first layer is selected so as to be a braze tape or a foil containing a matrix of braze alloy with an erosion resistant filler material essentially consisting of abrasive particles. The braze alloy may be a Silver (Ag)-based alloy or an Aluminum (Al)-based alloy or any other suitable alloy. The erosion resistant filler may be selected so as to consist of one or more filler materials selected from the group consisting of $Al_2O_3$, WC, CrC, or any other suitable erosion resistant material. The filler content may range from 60 to 90 Vol.-% of the first layer and sizes of the filler particles may range from 10 to 30 micrometer (μm).

In the present invention, a roughness of the first layer is made to be smaller than 2.3-micrometer (μm) depending on the first layer deposition technique.

Preferably, the first layer material is deposited using one or more deposition techniques selected from HVOF (High Velocity Oxygen Fuel)-spraying technique, tape/foil brazing technique, CVD (Chemical Vapor Deposition) technique, and laser cladding technique. In case the first layer material consists of one or more materials selected from the group of stainless steel and nickel (Ni)-based alloys, the first layer material may be deposited using HVOF (High Velocity Oxygen Fuel)-spraying technique.

In yet further aspects of the present invention, the second layer is preferably a sacrificial slurry coating. The sacrificial slurry coating may, for instance, be formed of a closely packed aluminum-filled chromate/phophate basecoat that is sealed with a chemically inert chromate/phosphate topcoat on top of the basecoat. Preferably, a roughness of the sacrificial slurry coating is made to be smaller than 1.6 micrometer (μm) depending on the first layer deposition technique.

According to a further aspect of the invention, a method of manufacturing a turbomachine blade includes the steps of:

providing the blade body, followed by a two-step process of depositing the corrosion and erosion protective coating on the blade body, namely a first deposition step of depositing an erosion and corrosion resistant first layer in order to cover at least the corrosion critical area, in particular the leading edge area of the blade body, and a subsequent second deposition step of depositing a sacrificial second layer over the first layer in order to cover at least the first layer, and preferably the whole blade body.

Deposition of the second layer may be effected using one or more standard spraying techniques. The first layer may be deposited on the base material by one of the two preferred following techniques, selected from tape/foil brazing technique or HVOF (High Velocity Oxygen Fuel)-spraying technique. However other deposition techniques such as CVD (Chemical Vapor Deposition) technique or Laser Cladding technique may also be used. In case the first layer material if formed of one or more materials selected from the group of stainless steel and nickel (Ni)-based alloys, the first layer material may be deposited using HVOF (High Velocity Oxygen Fuel)-spraying technique.

In a turbomachine blade having a blade body made of stainless steel, the first layer material may be deposited using tape/foil brazing technique. Upon doing so, brazing temperatures used may not exceed a tempering temperature of the stainless steel blade body material.

The above and still further aspects, features, and advantages of the present invention will become apparent upon consideration of the following detailed description of embodiments thereof.

DETAILED DESCRIPTION OF EXEMPLARY EMBODIMENTS

An embodiment of the present invention will be described in detail below with reference to the accompanying drawings.

Figure 1:
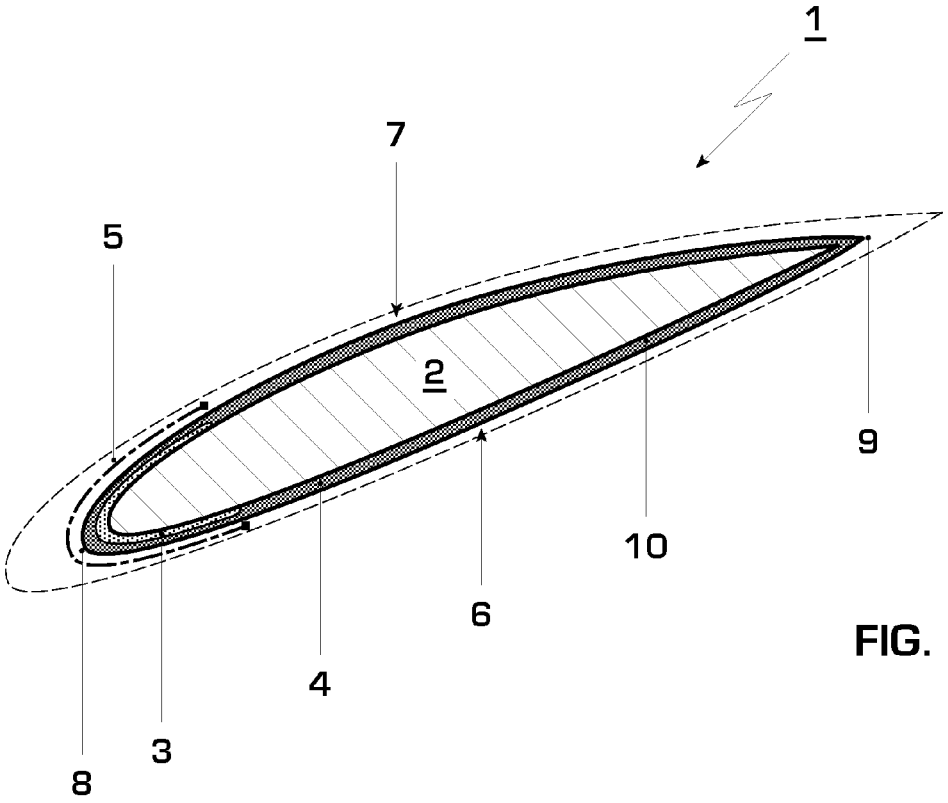
FIG. 1 schematically depicts a transversal sectional view of an embodiment of a compressor blade provided with a corrosion protective coating according to the present invention.

Reference is now made to FIG. 1 that shows a transversal sectional view of an embodiment of a compressor blade for a gas turbine which is provided with a corrosion protective coating according to the present invention.

A compressor blade 1 includes a blade body (substrate) 2 that, for instance, is made of stainless steel. Due to its typical body shape, the blade body has a major bulged pressure side 7 (in FIG. 1 upper side) and a minor bulged suction side 6 (in FIG. 1 lower side) both of which are formed to converge in a dull leading edge 8 and an acute trailing edge 9 of the blade body 2. The outer surface 10 of the blade body 2 is covered with a corrosion and erosion protective bilayer coating 11 that is bonded thereto.

The bilayer coating 11 includes a lower erosion resistant first layer 3 that is provided on the surface of blade body 2 and arranged in a leading edge area 5 surrounding the leading edge 8 on both the suction side 6 and the pressure side 7 of the blade body 2. The first layer 3 covers a covering area of up to 60% of the airfoil chord length starting from the leading edge 8 towards the trailing edge 9 of the blade body 2. In FIG. 1, the airfoil chord length can be identified by the outer surface 10 of the blade body 2.

The erosion resistant first layer 3 material is selected so as to provide erosion resistance against water droplets or particles impacting on the leading edge 8 area 5. It is selected so as to provide stainless steel corrosion resistance of the blade body 2 as well.

To this end, the first layer 3 is a braze tape or foil containing a matrix of braze alloy, such as a Silver (Ag)-based alloy or an Aluminium (Al)-based alloy, and an erosion resistant filler material, such as $Al_2O_3$, WC, and CrC. The filler content ranges from 60 Vol.-% to 90 Vol.-% of the first layer 3 and sizes of the filler particles preferably range from 10 to 30 micrometers (μm). The layer thickness of the first layer 3 preferably ranges from 50 to 100 μm.

The bilayer coating 11 further includes an upper sacrificial second layer 4 that covers (is deposited on) the first layer 3 and the remaining non-covered parts of the blade body 2 surface 10. The first layer 3 is sandwiched between the blade body 2 and the second layer 4. The second layer 4 is a sacrificial slurry coating that is formed of a closely packed aluminum-filled chromate/phophate basecoat that is sealed with a chemically inert chromate/phosphate topcoat on top of the basecoat (both basecoat and topcoat are not further detailed in FIG. 1). The second layer 4 has a layer thickness ranging from 50 to 100 μm, resulting in a total bilayer coating 11 thickness ranging from 100 to 200 μm.

Figure 2:
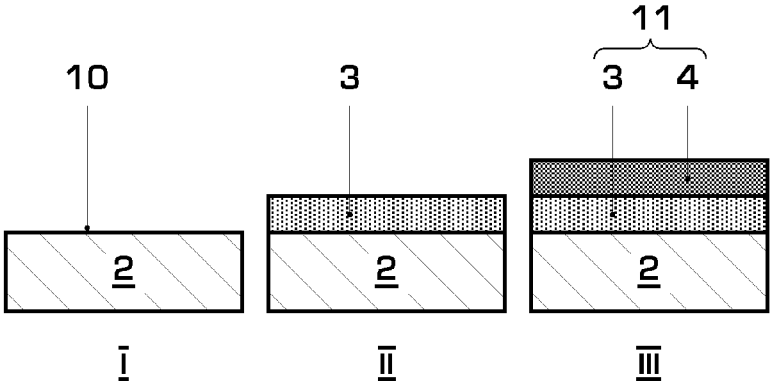
FIG. 2 schematically depicts a method of manufacturing the compressor blade shown in FIG. 1.

Reference is now made to FIG. 2 that schematically depicts a method of manufacturing the compressor blade 1 shown in FIG. 1, the method including two deposition steps for depositing the corrosion protective bilayer coating 11.

After a non-covered blade body 2 has been provided (step I), the erosion resistant first layer 3 is deposited on the surface (outer skin) 10 of the blade body 2 in the leading edge 8 area 5 (step II). In a further step, starting from a partly covered blade body 2 (step II), the sacrificial slurry second layer 4 is deposited on both the first layer 3 and the remaining non-covered portions of the blade body 2 surface 10 to thereby coat the whole blade body 2 (step III).

To deposit the first layer 3 on the base material tape/foil brazing technique or HVOF (High Velocity Oxygen Fuel)-spraying technique may be used. However other deposition techniques such as CVD (Chemical Vapor Deposition) technique or Laser Cladding technique may also be used. Deposition of the second layer may be effected using one or more standard spraying techniques.

The deposition techniques may be selected so as to achieve a roughness of both the erosion resistant first layer 3 and sacrificial slurry second layer 4 of less than 2.3 μm.

As can be seen from the above, by bonding a corrosion protective bilayer coating 11 on the outer surface 10 of the blade body 2, the working life of the blade 1 can be increased significantly because of the provision of an increased local erosion and corrosion protection and the risk of premature failure due to pitting corrosion attack is reduced. The bilayer coating and the process for coating can be realized with low costs. By restricting the erosion resistant first layer 3 to the leading edge area 5 of the blade body 2 that is particularly endangered by early erosion, manufacturing costs and time can be reduced additionally.

Compressor blades with a bilayer structure of the present invention are reconditionable.

REFERENCE LIST

| | |
|---|---|
| 1 | Turbomachine blade |
| 2 | Blade body |
| 3 | Erosion and corrosion resistant first layer |
| 4 | Sacrificial second layer |
| 5 | Leading edge area |
| 6 | Suction side |
| 7 | Pressure side |
| 8 | Leading edge |
| 9 | Trailing edge |
| 10 | Blade body surface |
| 11 | Corrosion protective bilayer coating |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A turbomachine blade comprising:

a blade body; and a corrosion protective multilayered coating bonded to the blade body, the multilayered coating comprising an erosion and corrosion resistant first layer at least covering a corrosion and erosion critical area of the blade body and a sacrificial second layer covering the first layer;

wherein the second layer comprises a sacrificial slurry coating; and wherein the sacrificial slurry coating is formed of a closely packed aluminum-filled chromate/phosphate basecoat sealed with a chemically inert chromate/phosphate topcoat.

2. A turbomachine blade according to claim 1, wherein the first layer exclusively covers the corrosion and erosion critical area of the blade body.

3. A turbomachine blade according to claim 1, wherein the second layer completely covers the blade body.

4. A turbomachine blade according to claim 1, wherein the first layer is sandwiched between the blade body and the second layer.

5. A turbomachine blade according to claim 1, wherein the corrosion critical area is a leading edge area of the blade.

6. A turbomachine blade according to claim 5, wherein the first layer covers an area of up to 30% of the chord length, starting from the leading edge towards the trailing edge, of the blade body.

7. A turbomachine blade according to claim 5, wherein the first layer covers an area of from 5% to 30% of the chord length, starting from the leading edge towards the trailing edge, of the blade body.

8. A turbomachine blade according to claim 5, wherein the first layer covers an area of up to 60% of the chord length, starting from the leading edge towards the trailing edge, of the blade body.

9. A turbomachine blade according to claim 1, wherein the first layer has a layer thickness in the range of from 50 to 100 micrometers.

10. A turbomachine blade according to claim 1, wherein the second layer has a layer thickness in the range of from 50 to 100 micrometers.

11. A turbomachine blade according to claim 1, wherein the first layer is formed of a material selected to provide erosion resistance against the impact of water droplets or particles.

12. A turbomachine blade according to claim 1, wherein the blade body material is stainless steel.

13. A turbomachine blade according to claim 12, wherein the first layer is formed of a material selected to provide stainless steel corrosion resistance.

14. A turbomachine blade according to claim 1, wherein a roughness of the first layer is less than 2.3 micrometer.

15. A turbomachine blade according to claim 1, wherein the first layer is a braze tape or foil containing a matrix of braze alloy with an erosion resistant filler of abrasive particles.

16. A turbomachine blade according to claim 15, wherein the braze alloy is a Silver (Ag)-based alloy or an Aluminum (Al)-based alloy.

17. A turbomachine blade according to claim 15, wherein the erosion resistant filler is a filler material selected from the group consisting of $Al_2O_3$, WC, and CrC, and combinations thereof.

18. A turbomachine blade according to claim 15, wherein the filler content ranges from 60 Vol.-% to 90 Vol.-% of the first layer.

19. A turbomachine blade according to claim 15, wherein sizes of the filler particles range from 10 to 30 micrometers.

20. A turbomachine blade according to claim 1, wherein the first layer material has been deposited by a technique selected from the group consisting of HVOF (High Velocity Oxygen Fuel)-spraying, tape/foil brazing, CVD (Chemical Vapor Deposition), laser cladding, and combinations thereof.

21. A turbomachine blade according to claim 1, wherein the first layer has been deposited by HVOF (High Velocity Oxygen Fuel)-spraying technique, and the first layer is formed of a material selected from the group consisting of stainless steel, nickel (Ni)-based alloys, and combinations thereof.

22. A turbomachine blade according to claim 1, wherein a roughness of the sacrificial slurry coating is less than 1.6 micrometers.

23. A turbomachine blade according to claim 1, wherein the blade is a compressor blade.

24. A method of manufacturing a turbomachine blade, the method comprising:

providing a blade body;

depositing an erosion and corrosion resistant first layer on the blade body to cover at least a corrosion critical area of the blade body; and after said depositing the first layer, depositing a sacrificial slurry coating over the first layer to cover at least the first layer, wherein the sacrificial slurry coating is formed of a closely packed aluminum-filled chromate/phosphate basecoat sealed with a chemically inert chromate/phosphate topcoat.

25. A method according to claim 24, wherein depositing the first layer comprises depositing to exclusively cover the corrosion critical area of the blade body.

26. A method according to claim 24, wherein depositing the second layer comprises depositing to completely cover the blade body.

27. A method according to claim 24, wherein depositing the first layer comprises depositing using a deposition technique selected from the group consisting of HVOF (High Velocity Oxygen Fuel)-spraying, tape/foil brazing, CVD (Chemical Vapor Deposition), laser cladding, and combinations thereof.

28. A method according to claim 24, wherein depositing the first layer comprises depositing using HVOF (High Velocity Oxygen Fuel)-spraying, and wherein the first layer is formed of a material selected from the group consisting of stainless steel, nickel (Ni)-based alloy, and combinations thereof.

29. A method according to claim 24, wherein depositing a first layer comprises depositing a first layer to cover at least a leading edge area of the blade body.

* * * * *